US009872541B2

(12) United States Patent
Shiao

(10) Patent No.: US 9,872,541 B2
(45) Date of Patent: Jan. 23, 2018

(54) LEATHER BELT

(71) Applicant: Kun-Lin Shiao, Taoyuan (TW)

(72) Inventor: Kun-Lin Shiao, Taoyuan (TW)

( * ) Notice: Subject to any disclaimer, the term of this patent is extended or adjusted under 35 U.S.C. 154(b) by 210 days.

(21) Appl. No.: 14/845,400

(22) Filed: Sep. 4, 2015

(65) Prior Publication Data

US 2017/0065035 A1 Mar. 9, 2017

(51) Int. Cl.

| | |
|---|---|
| ***A41F 3/00*** | (2006.01) |
| ***A41F 9/00*** | (2006.01) |
| ***A44B 1/04*** | (2006.01) |
| ***A44B 11/22*** | (2006.01) |
| ***A44B 11/00*** | (2006.01) |

(52) U.S. Cl.

CPC ..... *A44B 11/22* (2013.01); *A41F 9/002* (2013.01); *A44B 11/006* (2013.01)

(58) Field of Classification Search

CPC ..... A41F 9/00; A41F 9/002; Y10T 24/4026; Y10T 24/4033; Y10T 24/4088

USPC ..... 2/322, 319; 24/163 R

See application file for complete search history.

(56) References Cited

U.S. PATENT DOCUMENTS

| | | | | | |
|---|---|---|---|---|---|
| 3,913,147 | A * | 10/1975 | Ostrander | A44B 11/22 | 2/311 |
| 4,348,774 | A * | 9/1982 | Woodson | A41F 9/002 | 128/95.1 |
| 5,063,615 | A * | 11/1991 | Chernuchin | A41F 9/002 | 2/301 |
| 2011/0072560 | A1* | 3/2011 | Valdez | A41F 9/002 | 2/321 |

* cited by examiner

*Primary Examiner* — Khaled Annis
*Assistant Examiner* — Timothy K Trieu
(74) *Attorney, Agent, or Firm* — Bacon & Thomas, PLLC

(57) ABSTRACT

A leather belt has a buckle body and a belt body. The buckle body has a bottom base and a positioning segment. The bottom base has a through slot and a limiting groove. The through slot and the limiting groove are transversally formed through the bottom base and communicate with each other. The positioning segment is formed on and protrudes from the bottom base, and has a positioning rod. The belt body is connected to the buckle body and has a connecting end, a passing end, a first positioning hole, and multiple second positioning holes. The connecting end is connected to the positioning rod and is mounted in the limiting groove. The passing end is mounted in the through slot. The first positioning hole is formed through the belt body and is disposed around the positioning rod. The second positioning holes are formed through the belt body at intervals.

10 Claims, 7 Drawing Sheets

LEATHER BELT

BACKGROUND OF THE INVENTION

1. Field of the Invention

The present invention relates to a leather belt, and more particularly to a leather belt that has a simple structure and can be used conveniently without loosening.

2. Description of Related Art

A conventional leather belt is one of the commonly wearing parts and is widespread in use. The conventional leather belt has a buckle body and a belt body. The buckle body has a fixing mount with teeth to connect with the belt body, or the fixing mount is screwed with a base of the buckle body and is connected with the belt body. Then, a user can fasten the conventional leather belt by the buckle body and the belt body.

The conventional leather belt can be used for wearing, however, if the buckle body of the conventional leather belt is connected to the belt body by the teeth of the fixing mount, only a single side of the belt body can be used to connect with the fixing mount of the buckle body. In addition, the single side of the belt body may be damaged by the teeth of the fixing mount, and this will limit the practicability of the conventional leather belt.

Furthermore, if the belt body of the conventional leather belt is connected with the buckle body by screwing, two reverse sides of the belt body can be used to connect with the buckle body of the conventional leather belt. However, the buckle body itself has a certain number of components, and the complexity of structure and cost of manufacturing of the buckle body are increased. Additionally, a screw structure between the buckle body and the belt body of the conventional belt may wear off over time and loosen between the buckle body and the belt body. In addition, due to the complexity of structure of the buckle body, the user needs tools to replace or separate the buckle body from the belt body of the conventional leather belt, and this is inconvenient in use.

To overcome the shortcomings, the present invention provides a leather belt to mitigate or obviate the aforementioned problems.

SUMMARY OF THE INVENTION

The main objective of the present invention is to provide a leather belt that has a simple structure and can be used conveniently without loosening.

The leather belt in accordance with the present invention has a buckle body and a belt body. The buckle body has a bottom base and a positioning segment. The bottom base has a through slot and a limiting groove. The through slot and the limiting groove are transversally formed through the bottom base and communicate with each other. The positioning segment is formed on and protrudes from the bottom base, and has a positioning rod. The belt body is connected to the buckle body and has a connecting end, a passing end, a first positioning hole, and multiple second positioning holes. The connecting end is connected to the positioning rod and is mounted in the limiting groove. The passing end is mounted in the through slot. The first positioning hole is formed through the belt body and is disposed around the positioning rod. The second positioning holes are formed through the belt body at spaced intervals.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
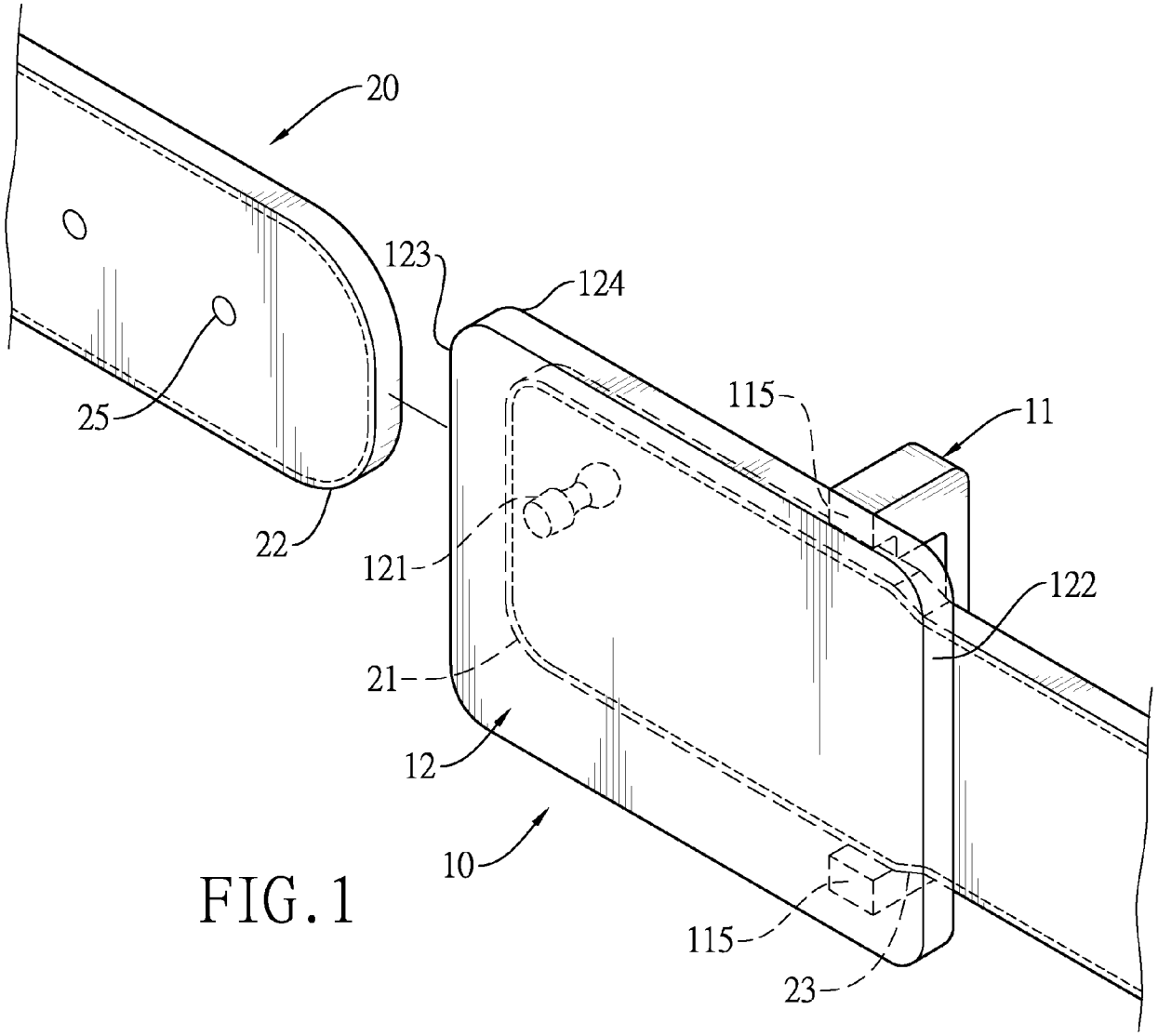
FIG. 1 is a perspective view of a first embodiment of a leather belt in accordance with the present invention.
Figure 2:
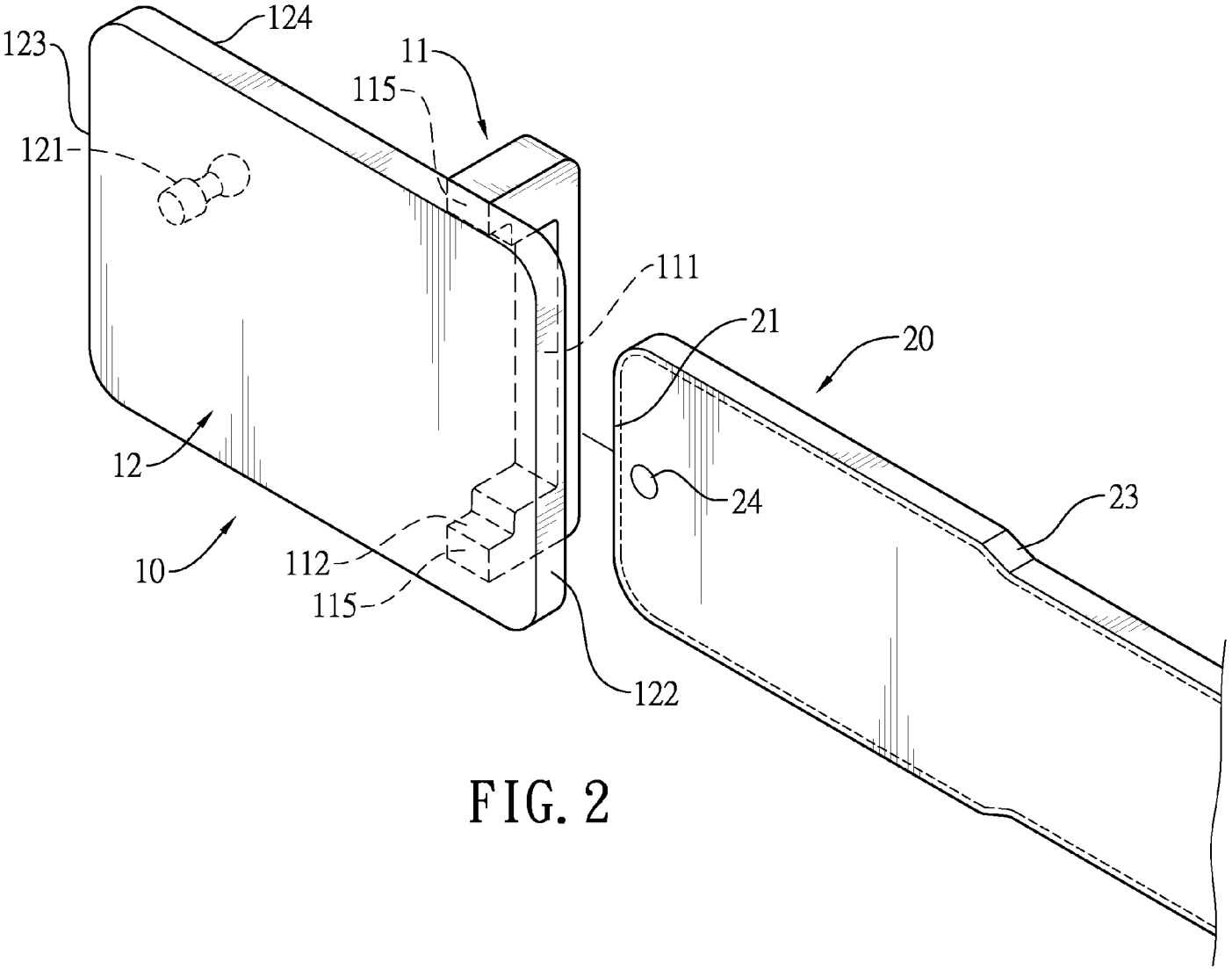
FIG. 2 is an exploded perspective view of the leather belt in FIG. 1.
Figure 3:
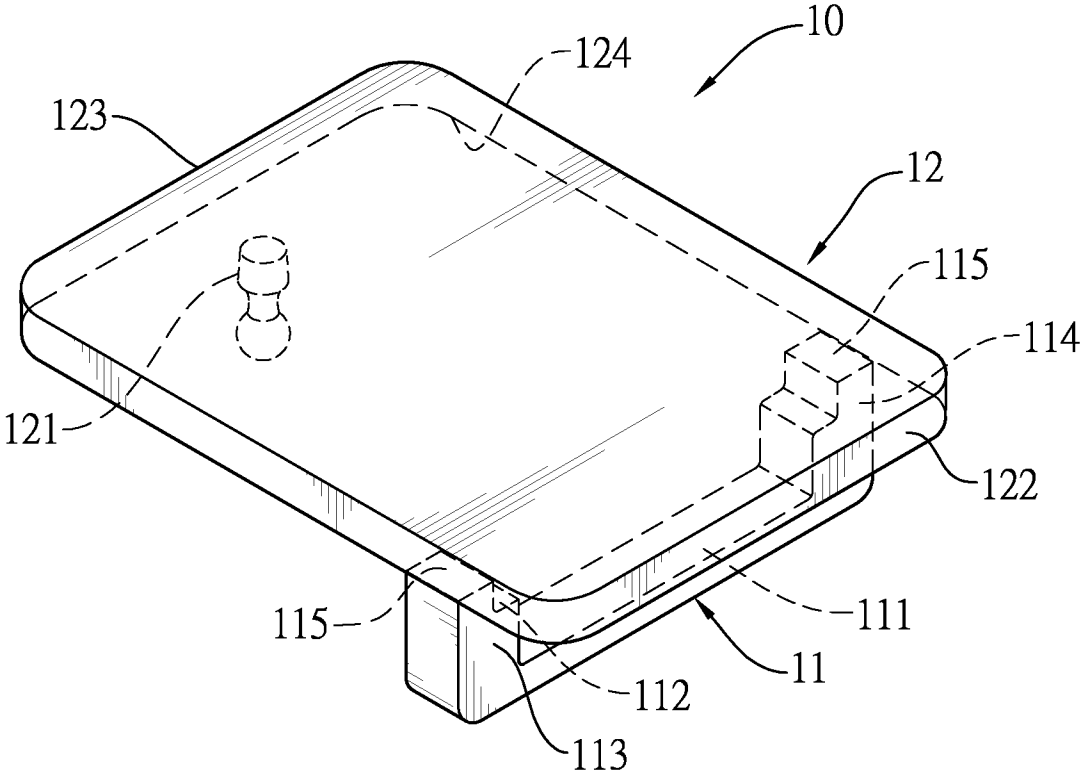
FIG. 3 is an enlarged perspective view of a buckle body of the leather belt in FIG. 1.

With reference to FIGS. 1 to 3, a leather belt in accordance with the present invention has a buckle body 10 and a belt body 20.

The buckle body 10 has a bottom base 11 and a positioning segment 12. The bottom base 11 may be a U-shaped frame, and has a lower section 113, an upper section 114, two free ends 115, a through slot 111, and a limiting groove 112. The through slot 111 is transversally formed through the lower section 113 of the bottom base 11 and has a width. The limiting groove 112 is transversally formed through the upper section 114 of the bottom base 11 between the two free ends 115 of the bottom base 11, communicates with the through slot 111, and has a width. The width of the through slot 111 is narrower than the width of the limiting groove 112, and this makes the bottom base 11 a stepped U-shaped frame with an opening gradually enlarged upward.

The positioning segment 12 may be rectangular, is formed on and protrudes from the two free ends 115 of the bottom base 11, and has a proximal end 122, a distal end 123, a bottom side 124, and a positioning rod 121. The bottom side 124 of the positioning segment 12 is formed with the two free ends 115 of the bottom base 11 adjacent to the proximal end 122 of the positioning segment 12 above the limiting groove 112. The distal end 123 of the positioning segment 12 extends away from the bottom base 11. The positioning rod 121 is formed on and protrudes from the bottom side 124 of the positioning segment 12 adjacent to the distal end 123 of the positioning segment 12, and has a length. The length of the positioning rod 121 is shorter than a sum of the two depths of the through slot 111 and the limiting groove 112.

Figure 4:
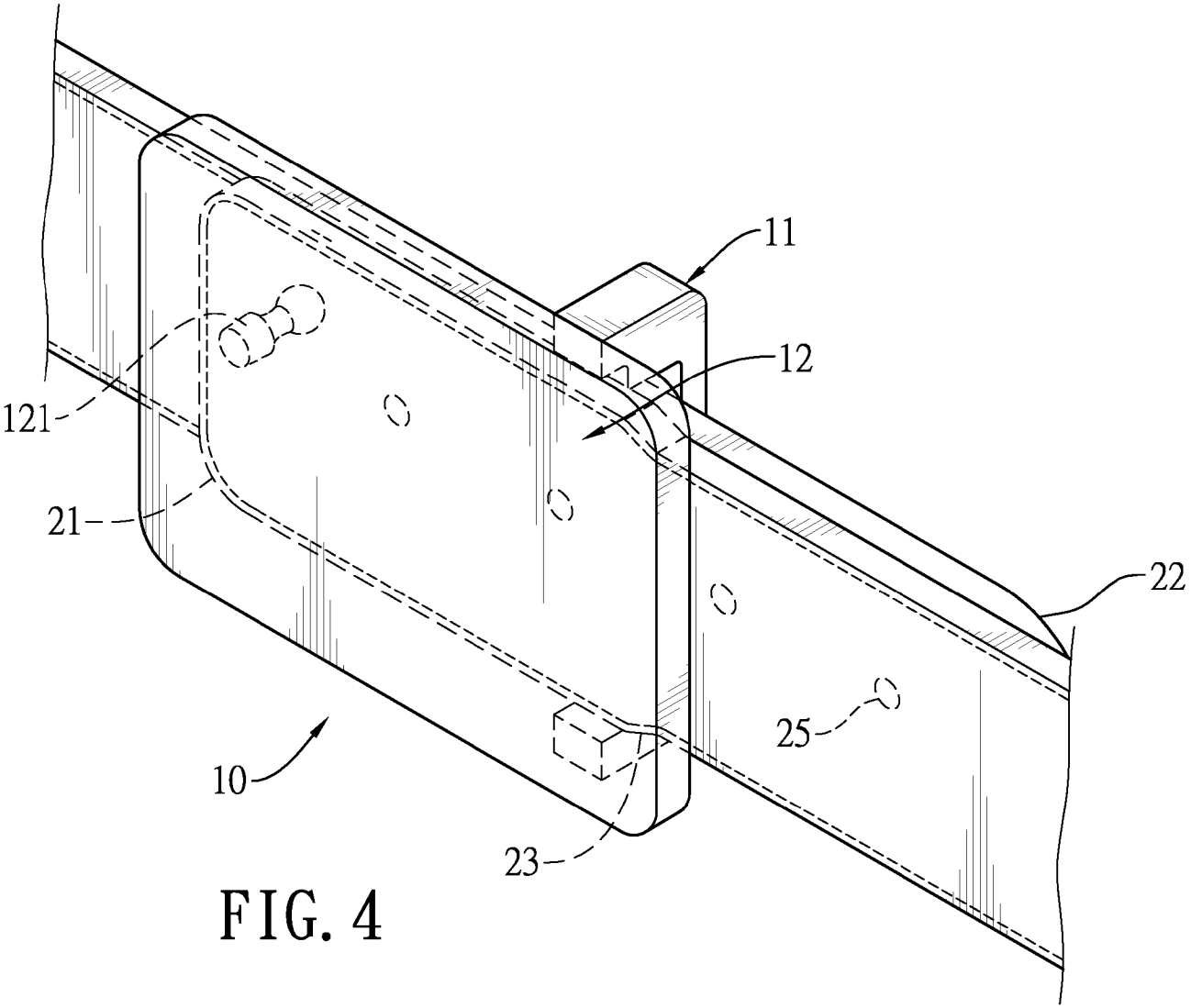
FIG. 4 is an operational perspective view of the leather belt in FIG. 1.
Figure 5:
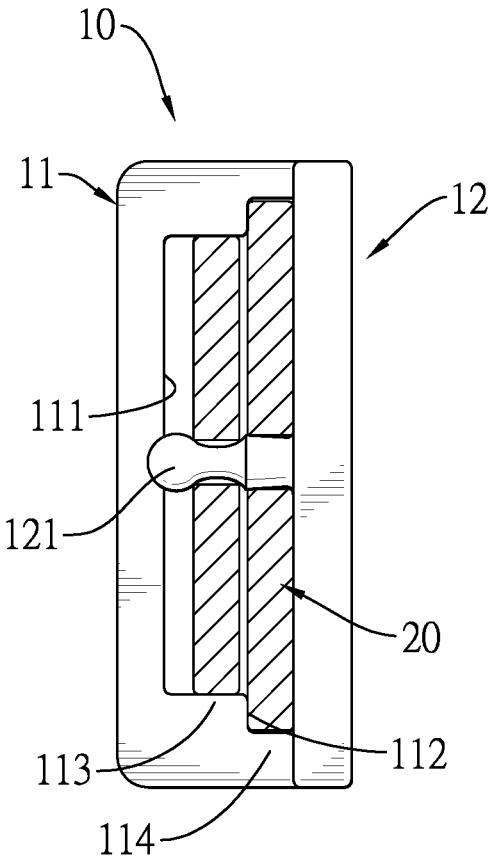
FIG. 5 is an operational side view in partial section of the leather belt in FIG. 4.

The belt body 20 is detachably connected to the buckle body 10 and has a connecting end 21, a passing end 22, a narrow section 23, a first positioning hole 24, and multiple second positioning holes 25. The connecting end 21 of the belt body 20 is mounted through the limiting groove 112 of the bottom base 11, and has a width corresponding to the width of the limiting groove 112. Then, the connecting end 21 of the belt body 20 can be securely mounted in the limiting groove 112 of the bottom base 11. With reference to FIGS. 4 and 5, the passing end 22 of the belt body 20 is formed with the connecting end 21 of the belt body 20, and is passed through the through slot 111 of the bottom base 11. The passing end 22 of the belt body 20 has a width corresponding to the width of the through slot 111 to enable the passing end 22 of the belt body 20 to be securely mounted in the through slot 111 of the bottom base 11.

Figure 8:
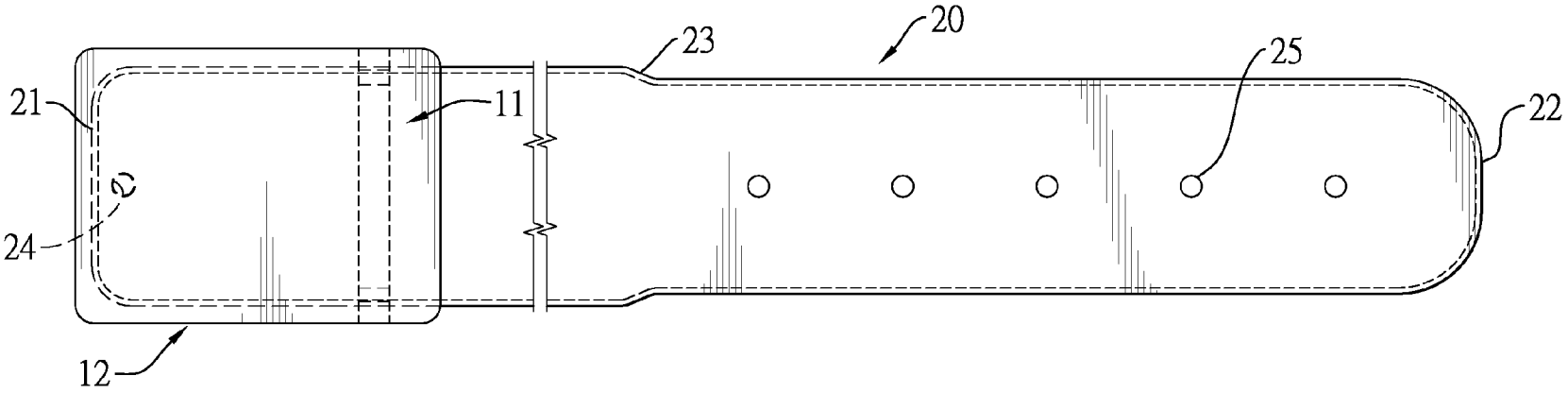
FIG. 8 is a side view of a second embodiment of a leather belt in accordance with the present invention.

The narrow section 23 is formed on the belt body 20 between the connecting end 21 and the passing end 22 of the belt body 20, and this enables the connecting end 21 and the passing end 22 of the belt body 20 to have different widths and to be respectively mounted in the limiting groove 112 and the through slot 111 of the bottom base 11. Then, the belt body 20 can be securely connected to the buckle body 10. Preferably, the narrow section 23 is formed on the belt body 20 adjacent to the connecting end 21 of the belt body 20 as shown in FIG. 1 of the present invention, or is formed on the belt body 20 adjacent to the passing end 22 of the belt body 20 as shown in FIG. 8 of the present invention.

Figure 6:
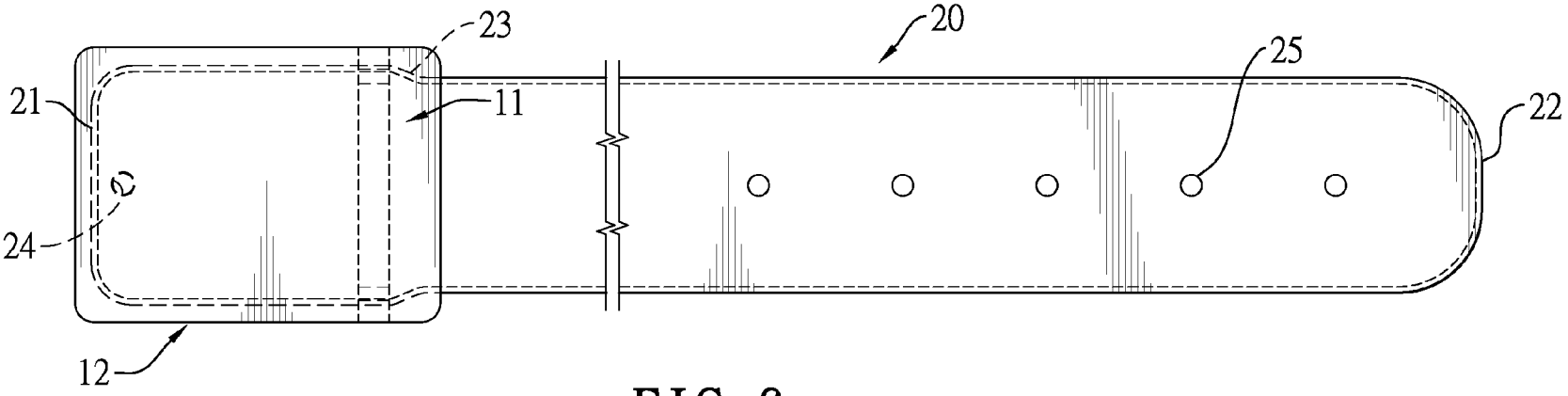
FIG. 6 is a side view of the leather belt in FIG. 1, showing a side of a belt body connected to the buckle body of the leather belt.
Figure 7:
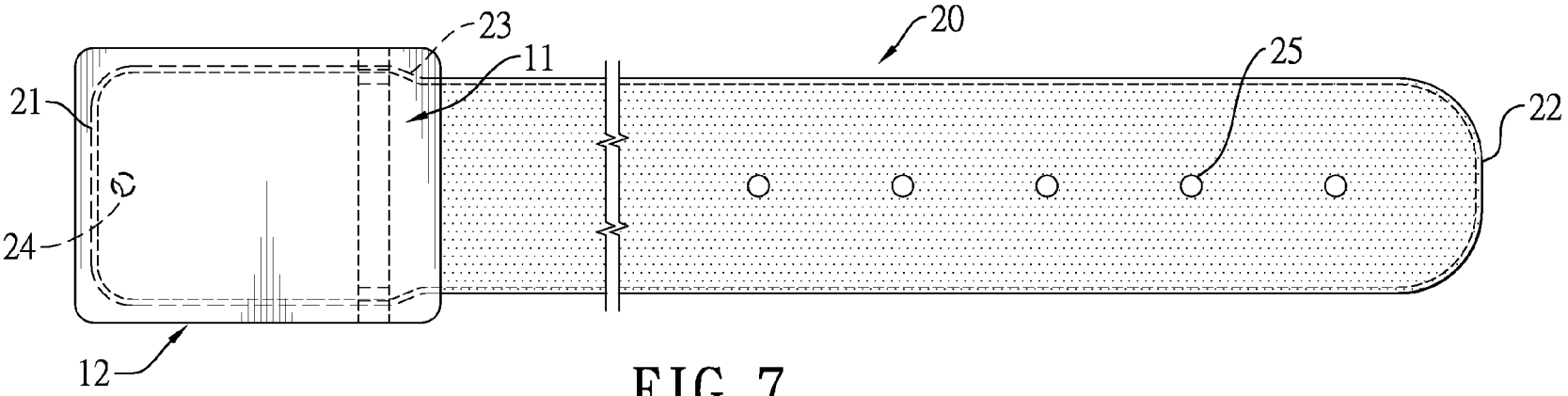
FIG. 7 is a side view of the leather belt in FIG. 1, showing another side of the belt body connected to the buckle body of the leather belt.

In addition, with reference to FIGS. 6 and 7, the belt body 20 has two reverse sides with different colors or different patterns to selectively connect with the buckle body 10. A user can connect one of the two reverse sides of the belt body 20 with the buckle body 10 according to the user's need. The first positioning hole 24 is formed through the two reverse sides of the belt body 20 adjacent to the connecting end 21, and is disposed around the positioning rod 121 to connect the connecting end 21 of the belt body 20 with the positioning segment 12 of the buckle body 10. The second positioning holes 25 are formed through the two reverse sides of the belt body 20 at spaced intervals adjacent to the passing end 22 of the belt body 20. When the passing end 22 of the belt body 20 passes through the through slot 111 of the bottom base 11, one of the second positioning holes 25 aligns with the first positioning hole 24 and is disposed around the positioning rod 121 of the positioning segment 12. Then, the connecting end 21 and the passing end 22 of the belt body 20 are respectively held in the limiting groove 112 and the through slot 111 by the positioning rod 121 of the positioning segment 12 mounted through the first positioning hole 24 and one of the second positioning holes 25 to form the leather belt as a fixed and annular structure for wearing on the user.

According to the above-mentioned features and structural relationships of the leather belt in accordance with the present invention, the connecting end 21 of the belt body 20 is securely mounted in the limiting groove 112 of the bottom base 11 by the positioning rod 121 of the positioning segment 12 and the limiting groove 112 of the bottom base 11. Then, the belt body 20 is securely connected to the buckle body 10 without rotating or loosening. Additionally, the passing end 22 of the belt body 20 passes through the through slot 111 of the bottom base 11 to enable the positioning rod 121 to be mounted through one of the second positioning holes 25. Consequently, the positioning rod 121 of the positioning segment 12 is not only used to connect the belt body 20 with the buckle body 10, but also used to adjust a length of the leather belt in use to provide a connecting and adjusting effect to the leather belt.

Furthermore, the limiting groove 112 and the through slot 111 of the buckle body 10 have different widths, and the connecting end 21 and the passing end 22 of the belt body 20 also have different widths by the narrow section 23 and are respectively corresponding to the limiting groove 112 and the through slot 111. When the belt body 20 is connected to the buckle body 10, the connecting end 21 of the belt body 20 is held in the limiting groove 112 of the bottom base 11, and the passing end 22 of the belt body 20 is held in the through slot 111 of the bottom base 11. Then, the belt body 20 is securely connected to the buckle body 10 by two limiting structural mechanisms between the connecting end 21 and the limiting groove 112, and between the passing end 22 and the through slot 111. In addition, the positioning rod 121 can be separated from the first positioning hole 24 without using tools, and the user can change between the two reverse sides of the belt body 20 to connect with the buckle body 10 according to the user's need as shown in FIGS. 6 and 7.

In summary, the belt body 20 of the leather belt is connected to the buckle body 10 by the first positioning hole 24 disposed around the positioning rod 121 and the connecting end 21 of the belt body 20 held and limited in the limiting groove 112 without using the teeth of the fixing mount of the buckle body of the conventional leather belt. Then, the two reverse sides of the belt body 20 will not be damaged by the buckle body 10, and the two reverse sides of the belt body 20 can be reconnected with the buckle body 10, and this can improve the practicability of the leather belt of the present invention. Furthermore, the two limiting structural mechanisms of the leather belt can simplify the structural complexity of the buckle body 10 and reduce the number of components of the buckle body 10. Then, the cost of manufacturing the buckle body 10 can be reduced. In addition, the belt body 20 can be securely connected to the buckle body 10 by the two limiting structural mechanisms between the connecting end 21 and the limiting groove 112 and between the passing end 22 and the through slot 111. In assembling and replacing of the leather belt, the positioning rod 121 can be separated from the first positioning hole 24 without using tools, and the user can change between the two reverse sides of the belt body 20 to connect with the buckle body 10 according to the user's need, and this is convenient in use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A leather belt having: a buckle body having a bottom base having a lower section; an upper section; two free ends;

a through slot transversally formed through the lower section of the bottom base and having a first width; and a limiting groove transversally formed through the upper section of the bottom base between the two free ends of the bottom base, communicating with the through slot and having a second width wider than the first width of the through slot to form the bottom base as a stepped U-shaped frame with an opening gradually enlarged upward; and a positioning segment formed on and protruding from the two free ends of the bottom base, and having a proximal end; a distal end extending away from the bottom base; a bottom side formed with the two free ends of the bottom base adjacent to the proximal end of the positioning segment; and a positioning rod formed on and protruding from the bottom side of the positioning segment adjacent to the distal end of the positioning segment; and a belt body detachably connected to the buckle body and having a connecting end mounted through the limiting groove of the bottom base, wherein the connecting end having a third width corresponding to the second width of the limiting groove;

a passing end formed with the connecting end of the belt body passed through the through slot of the bottom base, wherein the passing end having a fourth width corresponding to the first width of the through slot;

a narrow section formed on the belt body between the connecting end and the passing end of the belt body to enable the connecting end and the passing end of the belt body to have different widths and to be respectively mounted in the limiting groove and the through slot of the bottom base to provide two limiting structural mechanisms between the connecting end and the limiting groove, and between the passing end and the through slot; a first positioning hole formed through the belt body adjacent to the connecting end, and disposed around the positioning rod to connect the connecting end of the belt body with the positioning segment of the buckle body; and multiple second positioning holes formed through the belt body at spaced intervals adjacent to the passing end of the belt body, and one of the second positioning holes aligning with the first positioning hole and disposed around the positioning rod of the positioning segment.

2. The leather belt as claimed in claim 1, wherein the narrow section is formed on the belt body adjacent to the connecting end of the belt body.

3. The leather belt as claimed in claim 2, wherein the belt body has two reverse sides with different colors to selectively connect with the buckle body.

4. The leather belt as claimed in claim 3, wherein the positioning segment is rectangular.

5. The leather belt as claimed in claim 1, wherein the narrow section is formed on the belt body adjacent to the passing end of the belt body.

6. The leather belt as claimed in claim 5, wherein the belt body has two reverse sides with different colors to selectively connect with the buckle body.

7. The leather belt as claimed in claim 6, wherein the positioning segment is rectangular.

8. The leather belt as claimed in claim 1, wherein the belt body has two reverse sides with different colors to selectively connect with the buckle body.

9. The leather belt as claimed in claim 8, wherein the positioning segment is rectangular.

10. The leather belt as claimed in claim 1, wherein the positioning segment is rectangular.

* * * * *